US006602554B1

(12) United States Patent
Kwok

(10) Patent No.: US 6,602,554 B1
(45) Date of Patent: Aug. 5, 2003

(54) LIQUID ATOMIZATION METHOD AND SYSTEM

(75) Inventor: Kui-Chiu Kwok, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 39 days.

(21) Appl. No.: 09/483,647

(22) Filed: Jan. 14, 2000

(51) Int. Cl.[7] ..... B05D 1/02
(52) U.S. Cl. ..... 427/424; 427/421
(58) Field of Search ..... 427/421, 424, 427/426, 427; 118/313, 315; 239/296

(56) References Cited

U.S. PATENT DOCUMENTS

| | | | | |
|---|---|---|---|---|
| 2,031,387 | A | | 2/1936 | Schwarz |
| 2,212,448 | A | | 8/1940 | Modigliani |
| 2,297,726 | A | | 10/1942 | Stephanoff |
| 2,628,386 | A | | 2/1953 | Tornberg |
| 3,038,202 | A | | 6/1962 | Harkenrider |
| 3,176,345 | A | | 4/1965 | Powell |
| 3,178,770 | A | | 4/1965 | Willis |
| 3,192,562 | A | | 7/1965 | Powell |
| 3,192,563 | A | | 7/1965 | Crompton |
| 3,204,290 | A | | 9/1965 | Crompton |
| 3,213,170 | A | | 10/1965 | Erdmenger et al. |
| 3,253,301 | A | | 5/1966 | McGlaughlin |
| 3,334,792 | A | | 8/1967 | De Vries et al. |
| 3,380,128 | A | | 4/1968 | Cremer et al. |
| 3,488,806 | A | | 1/1970 | De Cecco et al. |
| 3,492,692 | A | | 2/1970 | Soda et al. |
| 3,501,805 | A | | 3/1970 | Douglas, Jr. et al. |
| 3,613,170 | A | | 10/1971 | Soda et al. |
| 3,650,866 | A | | 3/1972 | Prentice |
| 3,704,198 | A | | 11/1972 | Prentice |
| 3,755,527 | A | | 8/1973 | Keller et al. |
| 3,785,633 | A | * | 1/1974 | Karisson ..... 266/34 V |
| 3,825,379 | A | | 7/1974 | Lohkamp et al. |
| 3,849,241 | A | | 11/1974 | Butin et al. |
| 3,861,850 | A | | 1/1975 | Wallis |

(List continued on next page.)

FOREIGN PATENT DOCUMENTS

| | | |
|---|---|---|
| GB | 756907 | 6/1956 |
| GB | 1392667 | 4/1975 |
| WO | 9315895 | 8/1993 |

OTHER PUBLICATIONS

Non–Wovens World magazine, Meltblown Technology Today, 1989, pp. 1–158. (No Month Date).

The New Non–Wovens World, "Developments in Melt Blowing Technology", 1993, pp. 73–82. (No Month Date).

McNally et al., J & M Laboratory, "Durafiber/Durastitch Adhesives Applications Methods Featuring Solid State Application Technology", Sep. 8, 1997 at Inda–Tec 97 Meeting, Cambridge MA, pp. 26.1–.8.

Gregory F. Ward, "Micro–Denier NonWoven Process and Fabrics", on or about Oct. 1997, pp. 1–9.

Nordson Corp., "Control Coat System", "Control Fiberization Gun", "Meltex", "EP Coating Heads", Metering Technology, Web pages, Apr. 23, 1998, 9 pgs.

Rao et al., "Vibration and Stability in the Melt Blowing Process", 1993 pp. 3100–3111. (No Month Date).

Miller, "Beyond Melt Blowing; Process Refinement In Microfibre Hot Melt Adhesive Technology", 1998 11 pgs. (No Month Date).

*Primary Examiner*—Katherine A. Bareford
(74) *Attorney, Agent, or Firm*—Donald J. Breh

(57) ABSTRACT

Liquid atomization systems and methods including nozzle apparatuses having one or more liquid orifice and one or more fluid orifices associated with each liquid orifice for forming atomized liquid flows. In one application, one or more atomized liquid flows are formed adjacent a moving article and vacillated predominately non-parallel to the direction of the moving article, before depositing the vacillating atomized fluid flows onto the moving article.

9 Claims, 3 Drawing Sheets

U.S. PATENT DOCUMENTS 3,874,886 A 4/1975 Levecque et al.
3,888,610 A 6/1975 Brackman et al.
3,920,362 A 11/1975 Bradt
3,923,444 A 12/1975 Esper et al.
3,942,723 A 3/1976 Langdon
3,947,537 A 3/1976 Buntin et al.
3,970,417 A 7/1976 Page
3,978,185 A 8/1976 Buntin et al.
3,981,650 A 9/1976 Page
4,007,625 A 2/1977 Houben et al.
4,015,963 A 4/1977 Levecque et al.
4,015,964 A 4/1977 Levecque et al.
4,050,866 A 9/1977 Kilsdonk
4,052,002 A 10/1977 Stouffer et al.
4,052,183 A 10/1977 Levecque et al.
4,064,295 A * 12/1977 Singer ..... 427/424
4,100,324 A 7/1978 Anderson et al.
4,145,173 A 3/1979 Pelzer et al.
4,151,955 A 5/1979 Stouffer
4,185,981 A 1/1980 Ohsato et al.
4,189,455 A 2/1980 Raganato et al.
4,277,436 A 7/1981 Shah et al.
4,300,876 A 11/1981 Kane et al.
4,340,563 A 7/1982 Appel et al.
4,359,445 A 11/1982 Kane et al.
4,380,570 A 4/1983 Schwarz
4,457,685 A 7/1984 Huang et al.
4,526,733 A 7/1985 Lau
4,596,364 A 6/1986 Bauer
4,645,444 A 2/1987 Lenk et al.
4,652,225 A 3/1987 Dehennau et al.
4,681,258 A * 7/1987 Jenkins et al. ..... 239/66
4,694,992 A 9/1987 Stouffer
4,708,619 A 11/1987 Balk
4,746,283 A 5/1988 Hobson
4,747,986 A 5/1988 Chao
4,785,996 A 11/1988 Ziecker et al.
4,812,276 A 3/1989 Chao
4,818,463 A 4/1989 Buehning
4,818,464 A 4/1989 Lau
4,826,415 A 5/1989 Mende
4,874,451 A 10/1989 Boger et al.
4,889,476 A 12/1989 Buehning
4,891,249 A 1/1990 McIntyre
RE33,158 E 2/1990 Stouffer et al.
RE33,159 E 2/1990 Bauer et al.
4,905,909 A 3/1990 Woods
4,923,706 A 5/1990 Binley et al.
4,923,743 A * 5/1990 Stewart, Jr. ..... 427/288
4,949,668 A 8/1990 Heindel et al.
4,955,547 A 9/1990 Woods
RE33,448 E 11/1990 Bauer
RE33,481 E 12/1990 Ziecker et al.
4,983,109 A 1/1991 Miller et al.
5,013,232 A 5/1991 Way
5,017,116 A 5/1991 Carter et al.
RE33,605 E 6/1991 Bauer
5,035,361 A 7/1991 Stouffer
5,066,435 A 11/1991 Lorenz et al.
5,067,885 A 11/1991 Stevenson et al.
5,069,853 A 12/1991 Miller
5,094,792 A 3/1992 Baran
5,098,636 A 3/1992 Balk
5,114,752 A 5/1992 Hall
5,129,585 A 7/1992 Bauer
5,145,689 A 9/1992 Allen et al.
5,165,940 A 11/1992 Windley
5,207,970 A 5/1993 Joseph et al.
5,260,003 A 11/1993 Nyssen et al.
5,269,670 A 12/1993 Allen et al.
5,342,647 A 8/1994 Heindel et al.
5,354,378 A 10/1994 Hauser et al.
5,407,619 A 4/1995 Maeda et al.
5,409,733 A 4/1995 Boger et al.
5,418,009 A 5/1995 Raterman et al.
5,421,921 A 6/1995 Gill et al.
5,421,941 A 6/1995 Allen et al.
5,423,935 A 6/1995 Benecke et al.
5,429,840 A 7/1995 Raterman et al.
5,445,509 A 8/1995 Allen et al.
5,458,291 A 10/1995 Brusko et al.
5,458,721 A 10/1995 Raterman
5,478,224 A 12/1995 McGuffey
5,503,784 A 4/1996 Balk
5,524,828 A 6/1996 Raterman et al.
5,540,804 A 7/1996 Raterman
5,605,706 A 2/1997 Allen et al.
5,618,347 A 4/1997 Clare et al.
5,618,566 A 4/1997 Allen et al.
5,620,139 A 4/1997 Ziecker
5,652,048 A * 7/1997 Haynes et al. ..... 442/351
5,679,379 A 10/1997 Fabbricante et al.
5,902,540 A 5/1999 Kwok
5,904,298 A 5/1999 Kwok

* cited by examiner

LIQUID ATOMIZATION METHOD AND SYSTEM

BACKGROUND OF THE INVENTION

The invention relates generally to liquid atomization, and more particularly to liquid atomization methods and systems.

An object of the invention is to provide novel liquid atomization methods and systems that overcome problems and improve upon the prior art.

Another object of the invention is to provide novel liquid atomization methods and systems that are economical.

A further object of the invention is to provide novel liquid atomization methods and systems having improved atomization efficiency.

Another object of the invention is to provide novel liquid atomization methods and systems that produce more uniform atomization droplets.

A more particular object of the invention is to provide novel liquid atomization systems generally comprising a moving strand or substrate adjacent a nozzle apparatus, a vacillating atomized liquid flow disposed between the nozzle apparatus and the moving strand or substrate, wherein the vacillating atomized liquid flow has a predominant vacillation amplitude non-parallel to a direction of the moving strand or substrate.

Another more particular object of the invention is to provide novel liquid atomization systems generally comprising an atomization nozzle apparatus having a body member with a first orifice and two separate second orifices disposed on substantially opposite sides of the first orifice, the first and second orifices are formed by corresponding conduits in the body member, and a vacillating atomized liquid flow emanating from the first orifice. wherein the vacillating atomized liquid flow has a predominant vacillation amplitude between the two second orifices on substantially opposite sides of the first orifice.

Another more particular object of the invention is to provide novel liquid atomization systems comprising an atomization nozzle apparatus having a body member with a liquid orifice and a fluid orifice disposed adjacent the liquid orifice, the liquid and fluid orifices each formed by corresponding conduits in the body member, a fluid flow emanating from the fluid orifice, and a vacillating atomized liquid flow emanating from the liquid orifice, wherein the adjacent liquid and fluid orifices are spaced apart so that liquid dispensed from the liquid orifice is atomized by the fluid flow dispensed from the fluid orifice.

Another more particular object of the invention is to provide novel liquid atomization system nozzle apparatuses generally comprising a body member having a liquid orifice and at least one associated fluid orifice disposed adjacent the liquid orifice, the liquid orifice and associated fluid orifice each formed by corresponding conduits in the body member. The body member comprises a plurality of plates, wherein one of the plates has a plurality of liquid filtering slots located upstream of the liquid orifice.

Yet another more particular object of the invention is to provide novel liquid atomization system nozzle apparatuses generally comprising a body member having a concave surface, a plurality of orifice arrays disposed on the concave surface, wherein each orifice array has a liquid orifice and two fluid orifices, each of which is disposed on substantially opposite sides of the liquid orifice.

Another more particular object of the invention is to provide novel liquid atomization methods generally comprising forming an atomized liquid flow by drawing a liquid flow with two fluid flows directed along substantially opposite sides of the liquid flow, and vacillating the atomized liquid flow predominately between the two fluid flows on substantially opposite sides thereof.

Still another more particular object of the invention is to provide novel liquid atomization methods generally comprising forming an atomized liquid flow adjacent a moving article, vacillating the atomized liquid flow predominately non-parallel to a direction of the moving article, and depositing the vacillating atomized liquid flow onto the moving article.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THIE INVENTION

The liquid atomization nozzle apparatuses of the present invention atomize liquids, for example lotions, paints, water, oils, atomizable liquid solutions, and liquids having simultaneous gaseous and/or solid phases. Other liquids having insoluble materials suspended therein may also atomized by the nozzle apparatuses of the present invention.

In the present invention, liquid is dispensed through one or more liquid orifices of an atomization nozzle apparatus and a fluid like air is dispensed through one or more fluid orifices associated with the liquid orifice to draw and atomize the liquid into discrete droplets. More particularly, each liquid orifice and the one or more fluid orifices associated therewith are spaced apart on a body member of the nozzle apparatus so that liquid dispensed from the liquid orifice is drawn and atomized by one or more fluid flows, for example relatively high velocity air flows, emanating from the one or more fluid orifices associated with the liquid orifice, whereby the liquid flow is separated into discrete droplets.

The atomized liquid flow is preferably vacillated by the one or more fluid flows associated therewith to help separate the discrete droplets, and in some embodiments various parameters of vacillating droplets, for example the frequency and amplitude thereof, are controlled by fluid flows on opposites sides of the liquid flow.

The present invention has a wide range of applications including the dispensing of atomized liquids onto various articles including substrates and strands, for example in the deposition of atomized lotion onto facial tissue and onto substrates in the manufacture of bodily fluid absorbing hygienic articles. The invention and particularly the atomization nozzle apparatuses thereof may also be used for spray-drying applications, for example in the manufacture of pharmaceutical and other health care products, and for the dispensing of atomized oils and other liquids onto fibers, metals, glass and other articles.

Figure 1:
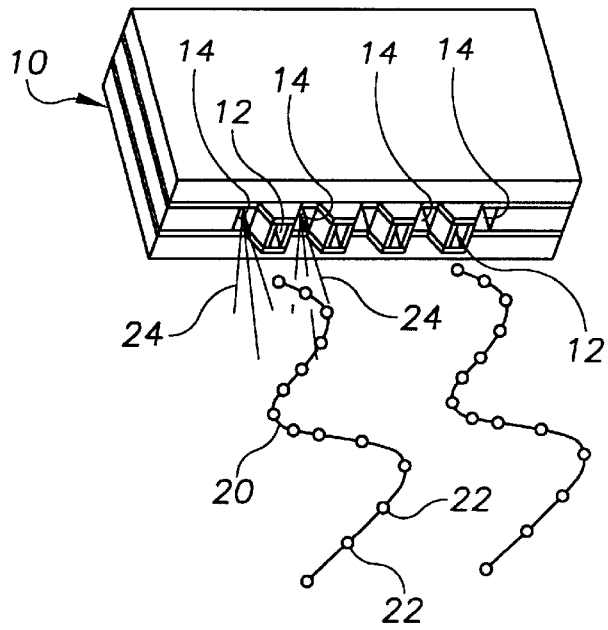
FIG. 1 is an exemplary liquid atomization nozzle apparatus.

FIG. 1 is an exemplary liquid atomization nozzle apparatus comprising generally a body member 10 having a first liquid orifice 12 and two separate second fluid orifices 14 disposed on substantially opposite sides thereof. The liquid and fluid orifices are formed by corresponding conduits disposed in the body member as discussed further below.

The exemplary nozzle apparatus of FIG. 1 has a plurality of liquid orifices 12, each of which is flanked on substantially opposite sides thereof by two corresponding fluid orifices 14. The plurality of liquid and fluid orifices 12 and 14 are arranged in an alternating series, wherein a single fluid orifice 14 is disposed between and shared by adjacent liquid orifices 12. In other embodiments, there may be two fluid orifices disposed in series between adjacent liquid orifices, whereby the liquid orifices do not share an intermediate fluid orifice.

In the preferred exemplary embodiment, the one or more liquid orifices 12 protrude relative to the corresponding one or more fluid orifices 14 associated therewith. In other embodiments, however, the associated liquid and fluid orifices may be located flushly on a common surface of the body member.

In FIG. 1, an atomized liquid flow 20 comprising discrete droplets 22, only some of which are identified by numerals, is formed by drawing a liquid flow emanating from the liquid orifice 12 with two fluid flows 24 emanating from two fluid orifices 14 directed along substantially opposing or opposite sides of the liquid flow. The discrete droplets 22 of the atomized liquid flow 20 are shown interconnected with a continuous line to illustrate the vacillating character thereof as discussed further below, but the discrete droplets 22 are in reality separate and disconnected from one another.

In FIG. 1, the discrete droplets 22 of the atomized liquid flow 20 are attracted by relatively low pressure associated with the fluid flows 24 on opposites sides thereof. The two fluid flows 24 thus have the effect of vacillating the discrete droplets 22 predominately between the two fluid flows 24 emanating from the corresponding fluid orifices 14 on substantially opposite sides thereof. In other words, a predominate vacillation amplitude of the discrete droplets is largely between the fluid orifices on opposites sides of the liquid orifice from which the atomized liquid emanates. The vacillation caused by the fluid flows helps separate the discrete liquid droplets 22.

The vacillation of the atomized liquid flow 20 may also be controlled, for example the vacillation may be made substantially periodic and the amplitude and frequency thereof may be varied, by appropriately controlling the flow rate of the fluid flows emanating from the fluid orifices associated with the liquid orifice from which the liquid is dispensed.

In other embodiments, the nozzle apparatus comprises a plurality of orifice arrays each having a liquid orifice with two fluid orifices disposed on substantially opposite sides thereof. The arrays are disposed on the body member at various angles relative to each other. According to this alternative nozzle apparatus configuration, the atomized liquid flows emanating from the orifice arrays vacillate in different directions, dependent upon the orientation of the corresponding orifice arrays.

Figure 2:
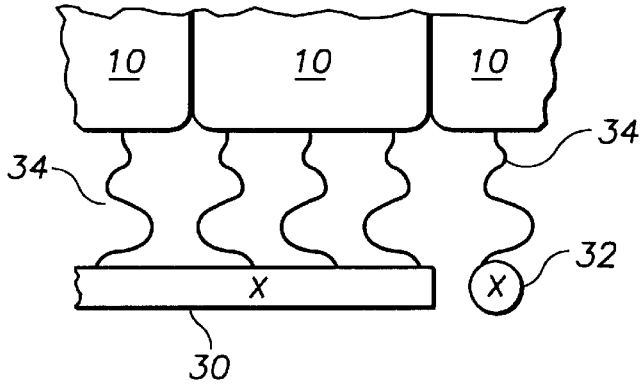
FIG. 2 is an exemplary liquid atomization system.

The liquid atomization system of FIG. 2 illustrates a plurality of atomization nozzle apparatus body members 10 arranged side by side for deposition of atomized liquid flows onto target objects and more particularly onto a substrate 30 and a strand 32 located adjacent thereto. In other systems, the target objects may be any article other than a substrate or strand, for example an article to be painted. The atomized liquid flows are illustrated schematically as continuous lines 34, which are representative of the discrete droplets.

The one or more liquid atomization nozzle apparatuses may be coupled to a manifold or some other device that supplies an atomizable liquid and atomizing fluid like air thereto. A manifold suitable for this application is disclosed in U.S. Pat. No. 5,862,986 entitled "Hot Melt Adhesive Applicator With Metering Gear-Driven Head" assigned commonly herewith and incorporated by reference herein.

In one exemplary liquid atomization system application, one or more atomized liquid flows are formed adjacent a moving strand or a moving substrate, and some or all of the atomized liquid flows are vacillated predominately non-parallel to a direction of the moving strand or substrate, for example transversely relative thereto, and then deposited on the moving strand or substrate. In some applications, the strand may be isolated in space where the atomized liquid is applied thereto, for example to more completely coat all sides thereof.

In the exemplary applications of FIG. 2, the vacillating atomized liquid flows 34 are disposed between the nozzle apparatuses and the moving strand and substrate, and have a predominant vacillation amplitude that is generally non-parallel to the direction of the moving strand and substrate, which movement direction is into or out of the drawing sheet.

A nozzle apparatus suitable for these exemplary liquid atomization system applications is of the type illustrated in FIG. 1, wherein the atomized liquid flow vacillates predominately between two fluid flows 24 emanating from corresponding fluid orifices 14 on substantially opposite sides of the liquid orifice 12 from which the atomized liquid flow emanates. As noted above, the direction of the predominant vacillation amplitude of the atomized liquid flows is determined by the orientation of the corresponding orifice array on the body member. The predominant vacillation amplitude of the atomized liquid flow may thus be oriented parallel or transversely or anywhere therebetween relative to the direction of the moving article by appropriately positioning the nozzle apparatus and more particularly the corresponding orifices array relative to the direction of the moving article.

Figure 3:
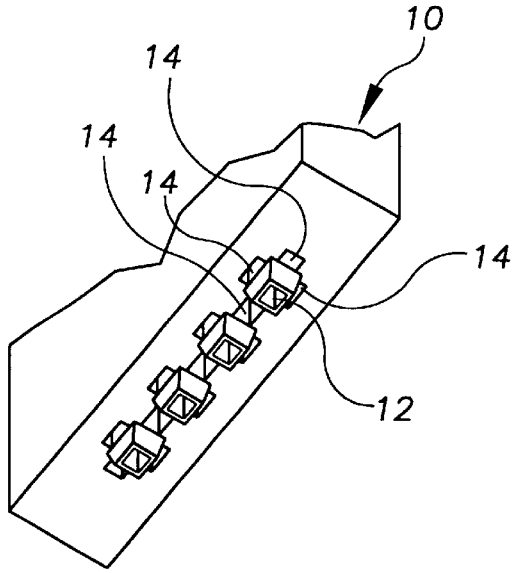
FIG. 3 is another exemplary liquid atomization nozzle apparatus.
Figure 4:
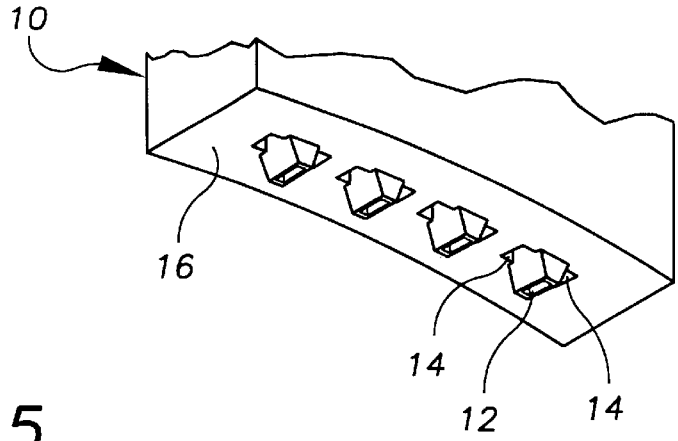
FIG. 4 is an exemplary converging liquid atomization nozzle apparatus.
Figure 5:
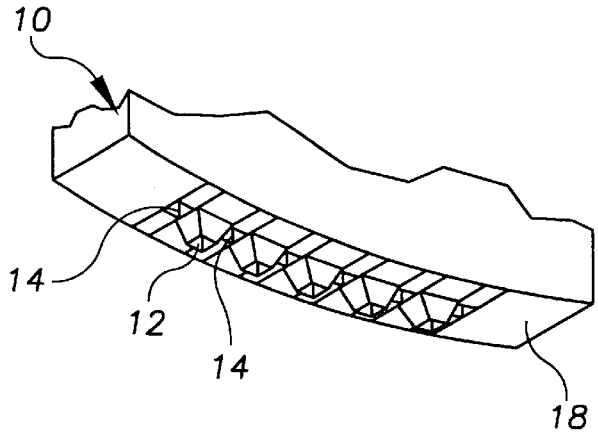
FIG. 5 is an exemplary diverging liquid atomization nozzle apparatus.

In FIG. 3, a body member 10 has a plurality of liquid orifices 12, wherein each liquid orifice has associated therewith four fluid orifices 14. The nozzle apparatus of FIG. 3 produces atomized liquid flows having a different vacillation characteristic than that illustrated in FIG. 1 by virtue of the four fluid flows that emanate from the four fluid orifices 14 thereof FIGS. 4 and 5 illustrate liquid atomization nozzle apparatuses each having a body member 10 with a plurality of orifice arrays disposed on a generally arcuate surface thereof. The orifice arrays each comprise a liquid orifice 12 flanked on substantially opposite sides by two fluid orifices 14, although the arrays may have more or less than two fluid orifices as discussed further below. The orifice arrays in the exemplary embodiments are arranged in a series, but in other embodiments the orifice arrays may be arranged differently.

In FIG. 4, the generally arcuate surface of the body member 10 has a concave surface 16 that focuses or converges the vacillating atomized liquid flows that emanate from the orifice arrays thereon, which is desirable for some applications. The nozzle apparatus of FIG. 4 may be one of several nozzle apparatuses arranged side by side on a common manifold, wherein the concaved surfaces 16 of adjacent body members 10 form a continuous concave surface, and in some configuration a form a closed ring of nozzle apparatuses, wherein the atomized liquid flows are directed radially inwardly therefrom.

In FIG. 5, the generally arcuate surface of the body member 10 has a convex surface 18 that diverges the vacillating atomized liquid flows emanating from the orifice arrays thereon, which may be desirable in other applications. The nozzle apparatus of FIG. 5 may also be one of several nozzle apparatuses arranged side by side on a common manifold, wherein the convex surfaces 18 of adjacent body members 10 form a continuous convex surface, and in some configurations may also form a ring of nozzle apparatuses, wherein the atomized liquid flows are directed radially outwardly therefrom.

Figure 6:
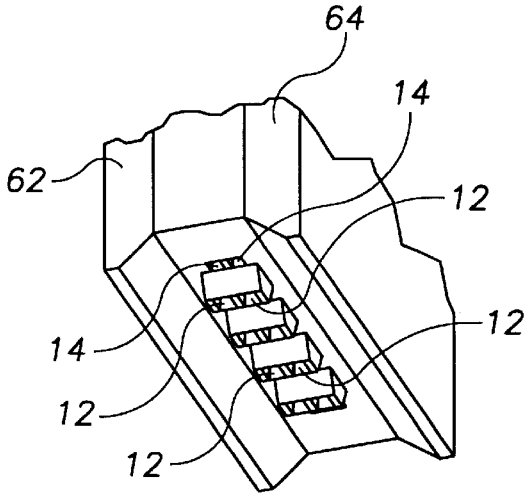
FIG. 6 is an exemplary multi-row liquid atomization nozzle apparatus.
Figure 7:
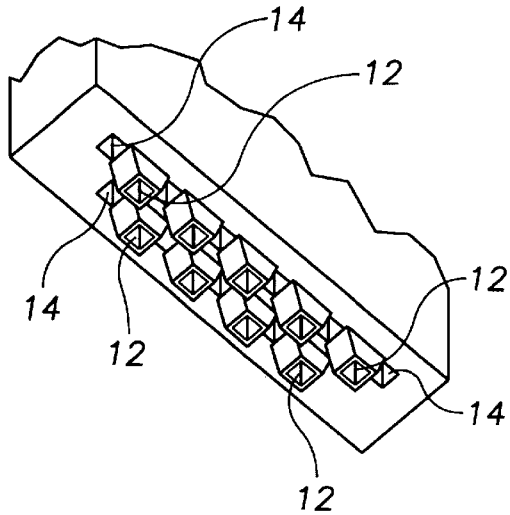
FIG. 7 is another exemplary multi-row liquid atomization nozzle apparatus.

FIGS. 6 and 7 both illustrate liquid atomization nozzle apparatuses having a body member 10 with multiple rows of liquid orifices 12, each of which has one or more fluid orifices 14 associated therewith, as discussed above. In FIG. 6, the liquid orifices 12 of the adjacent rows thereof are arranged side by side. In FIG. 7, the liquid orifices 12 in the adjacent rows thereof are offset relative to each other.

Figure 8:
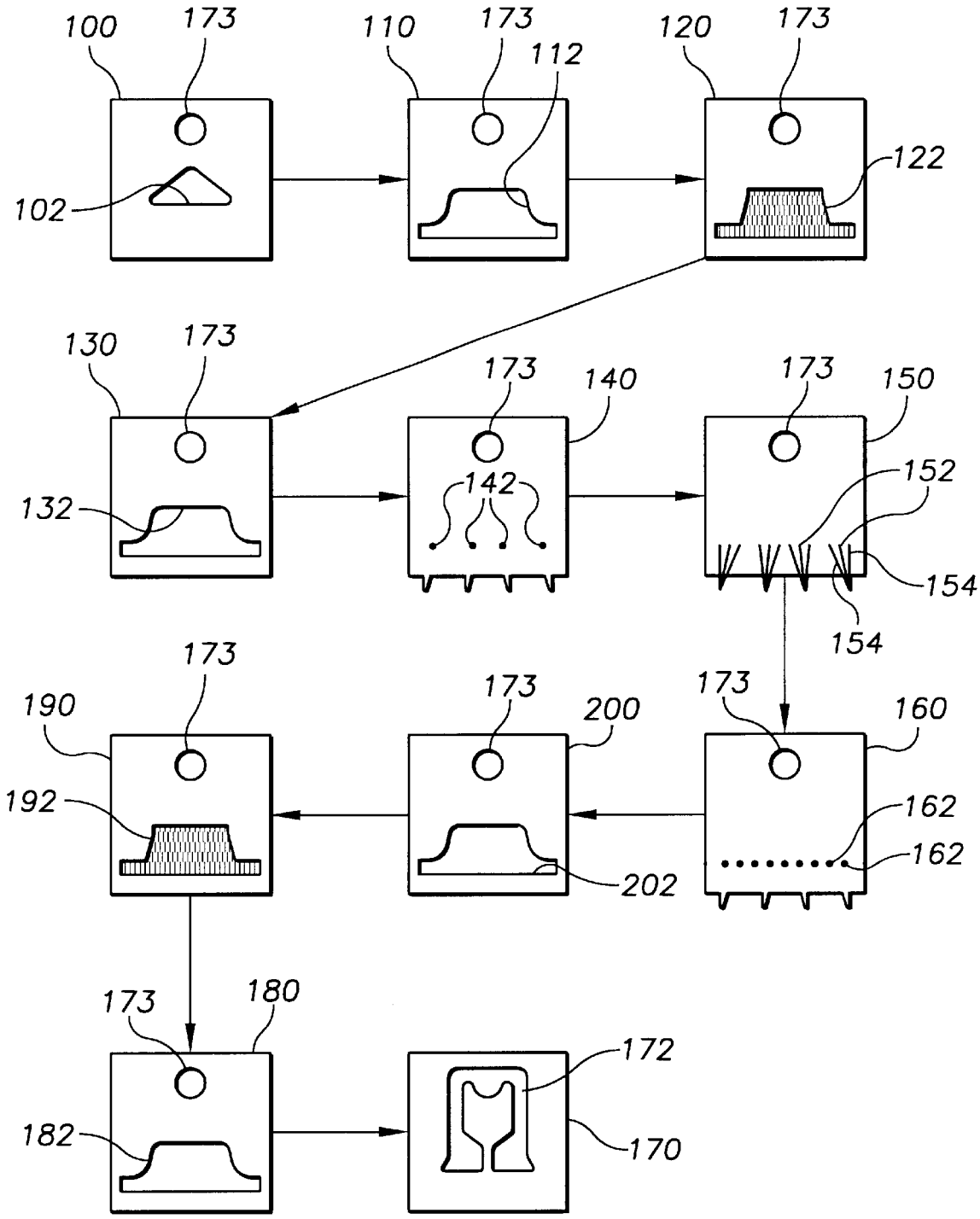
FIG. 8 is an exemplary parallel plate liquid atomization nozzle.

FIG. 8 is an exemplary nozzle apparatus comprising a plurality of parallel plates which are stacked one on top of the other and fastened together to form an atomization nozzle apparatus assembly.

The assembly of FIG. 8 comprises a liquid distribution plate 100 having a liquid distribution opening 102 in communication with a liquid accumulation cavity opening of one or more adjacent liquid accumulation plates.

In the exemplary embodiment of FIG. 8, a first liquid accumulation plate 110 has a first liquid accumulation cavity opening 112 adjacent and in communication with a liquid filter 122 of a filter plate 120.

The liquid filter 122 is formed by a plurality of slots of varying length. The filter slot width is preferably smaller than the smallest dimension of the one or more liquid orifices to which the filtered liquid is supplied. In one embodiment, the liquid orifice is square or rectangular in cross section and has a dimension of approximately 0.008 inches across its smallest side, and the slot width of the filter is approximately 0.005 inches.

A second liquid accumulation plate 130 having a second liquid accumulation cavity opening 132 is preferably disposed adjacent to and on an opposite side of the liquid filter 122 as the plate 110. In other embodiments, the liquid filter plate 120 is not included in the nozzle apparatus, and the first and second liquid accumulation plates are either adjacent each other or constitute a single, relatively thick unitary plate.

In FIG. 8, the liquid accumulation cavity opening 132 is adjacent to and in communication with one or more liquid openings 142 of an adjacent plate 140. The liquid openings 142 of the plate 140 are adjacent to and in communication with a corresponding plurality of liquid conduit openings 152, only some of which are identified with numerals, in plate 150. The liquid conduit openings 152 form liquid conduits when the plate 150 is assembled between adjacent plates 140 and 160, which is discussed below, and the liquid conduits form the liquid orifices from which the atomizable liquid is dispensed or emanates.

In FIG. 8, the plate 160 has one or more fluid openings 162, only some of which are identified with numerals, adjacent to and in communication with corresponding fluid conduit openings 154 in the plate 150. The fluid conduit openings 154 form fluid conduits when the plate 150 is assembled between the adjacent plates 140 and 160. In the exemplary nozzle, each liquid conduit has associated therewith on opposite sides thereof two fluid conduits, which form the fluid orifices of the apparatus.

In FIG. 8, a fluid distribution plate 170 includes a fluid distribution opening 172 in communication with a fluid accumulation cavity opening of one or more adjacent fluid accumulation plates. The fluid distribution opening 172 is in communication with a fluid passage formed by a plurality of aligned fluid openings 173 in each of the plates 100–160 and plates 180–200. Thus configured, the atomizable liquid and fluid may be supplied from the same side of the nozzle apparatus. In other embodiments, however, the fluid and liquid are supplied from opposites sides of the nozzle apparatus, thereby eliminating the requirement for the fluid openings 173 in all of the plates.

In the exemplary embodiment of FIG. 8, a first fluid accumulation plate 180 has a first fluid accumulation cavity opening 182 adjacent to and in communication with a fluid filter 192 of a second filter plate 190. A second fluid accumulation plate 200 having a second fluid accumulation cavity opening 202 is preferably disposed adjacent to and on an opposite side of the fluid filter 190 as plate 180. The fluid accumulation cavity opening 202 is adjacent to and in communication with the liquid openings 162 of plate 160, thereby supplying fluid to the fluid conduits and orifices formed by plates 140, 150 and 160.

The parallel plates of the exemplary nozzle apparatus of FIG. 8 may be formed of metal or other materials in a stamping operation or by laser cutting or chemical etching or other known processes. The parallel plates are preferably clamped between end plates, for example the end plates 62 and 64 of FIG. 6, with threaded fasteners disposed therethrough. In other embodiments, the parallel plates are fastened by other means, for example by brazing.

In other embodiments, the nozzle apparatuses of the present invention comprise one or more plates, which are not necessarily parallel, wherein the orifices and passages therein are formed by more conventional means, including drilling and milling operations.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A liquid atomization method comprising:

forming an atomized liquid flow adjacent a moving article by drawing a liquid with continuous fluid flows directed along substantially opposite sides of the liquid;

vacillating the atomized liquid flow predominately non-parallel to a direction of the moving article;

depositing the vacillating atomized liquid flow on the moving article.

2. The method of claim 1, forming the atomized liquid flow by drawing the liquid with two separate continuous fluid flows directed along substantially opposite sides of the liquid.

3. The method of claim 1, dispensing the liquid from a first orifice in a body member, forming the continuous fluid flows by dispensing fluid from corresponding fluid orifices disposed in the body member on substantially opposite sides of the first orifice.

4. The method of claim 1, vacillating the atomized liquid flow with the continuous fluid flows directed along substantially opposite sides of the liquid.

5. A liquid atomization method comprising:

forming an atomized liquid flow by drawing a liquid flow with two continuous fluid flows directed along substantially opposite sides of the liquid flow;

vacillating the atomized liquid flow predominately between the two fluid flows on substantially opposite sides thereof.

6. The method of claim 5, forming the liquid flow by dispensing a liquid from a first orifice in a body member, forming the two continuous fluid flows by dispensing a fluid from corresponding separate second orifices in the body member on substantially opposite sides of the first orifice.

7. The method of claim 5, forming a plurality of atomized liquid flows by drawing a plurality of liquid flows with a plurality of fluid flows, each liquid flow having two continuous fluid flows directed along substantially opposite sides thereof;

vacillating the plurality of atomized liquid flows predominately between the two continuous fluid flows on substantially opposite sides thereof.

8. The method of claim 7, forming the plurality of liquid flows by dispensing a liquid from a plurality of first orifices in a body member, forming the plurality of fluid flows by dispensing a fluid from a plurality of second orifices disposed in the body member, each first orifice having two second orifices disposed on substantially opposite sides thereof.

9. The method of claim 5, vacillating the atomized liquid flow by the two fluid flows on substantially opposite sides thereof.

* * * * *